US008514169B2

(12) United States Patent
Chui et al.

(10) Patent No.: US 8,514,169 B2
(45) **Date of Patent: *Aug. 20, 2013**

(54) APPARATUS AND SYSTEM FOR WRITING DATA TO ELECTROMECHANICAL DISPLAY ELEMENTS

(75) Inventors: Clarence Chui, San Jose, CA (US); Manish Kothari, Cupertino, CA (US)

(73) Assignee: QUALCOMM MEMS Technologies, Inc., San Diego, CA (US)

( * ) Notice: Subject to any disclaimer, the term of this patent is extended or adjusted under 35 U.S.C. 154(b) by 393 days.

This patent is subject to a terminal disclaimer.

(21) Appl. No.: 12/578,547

(22) Filed: Oct. 13, 2009

(65) Prior Publication Data

US 2010/0026680 A1 Feb. 4, 2010

Related U.S. Application Data

(63) Continuation of application No. 11/234,061, filed on Sep. 22, 2005, now Pat. No. 8,310,441, which is a continuation-in-part of application No. 11/100,762, filed on Apr. 6, 2005, now Pat. No. 7,602,375, application No. 12/578,547, which is a continuation-in-part of application No. 11/100,762.

(60) Provisional application No. 60/613,483, filed on Sep. 27, 2004, provisional application No. 60/613,419, filed on Sep. 27, 2004.

(51) Int. Cl.
*G09G 3/34* (2006.01)

(52) U.S. Cl.
USPC ..... 345/108; 345/54; 345/79; 345/96; 345/209

(58) Field of Classification Search
USPC ..... 345/108, 54, 79, 96, 109–110, 209
See application file for complete search history.

(56) References Cited

U.S. PATENT DOCUMENTS

| | | | |
|---|---|---|---|
| 4,709,995 | A | 12/1987 | Kuribayashi et al. |
| 4,954,789 | A | 9/1990 | Sampsell |
| 5,055,833 | A | 10/1991 | Hehlen et al. |
| 5,227,900 | A | 7/1993 | Inaba et al. |
| 5,285,196 | A | 2/1994 | Gale |
| 5,497,262 | A | 3/1996 | Kaeriyama |
| 5,699,075 | A | 12/1997 | Miyamoto |
| 5,726,675 | A | 3/1998 | Inoue |
| 5,754,160 | A | 5/1998 | Shimizu et al. |
| 5,771,116 | A | 6/1998 | Miller et al. |

(Continued)

FOREIGN PATENT DOCUMENTS

| | | |
|---|---|---|
| EP | 0 295 802 | 12/1988 |
| EP | 0 300 754 | 1/1989 |

(Continued)

OTHER PUBLICATIONS

Office Action dated Jul. 11, 2011, in U.S. Appl. No. 11/234,061.

(Continued)

*Primary Examiner* — Michael Pervan
(74) *Attorney, Agent, or Firm* — Knobbe, Martens, Olson & Bear, LLP

(57) ABSTRACT

Charge balanced display data writing systems, apparatuses, and methods use write and hold cycles of opposite polarity during selected frame update periods. A release cycle may be provided to reduce the chance that a given display element will become stuck in an actuated state.

24 Claims, 10 Drawing Sheets

(56) References Cited

U.S. PATENT DOCUMENTS

| | | | |
|---|---|---|---|
| 5,784,189 | A | 7/1998 | Bozler et al. |
| 5,828,367 | A | 10/1998 | Kuga |
| 5,883,608 | A | 3/1999 | Hashimoto |
| 5,883,684 | A | 3/1999 | Millikan et al. |
| 5,912,758 | A | 6/1999 | Knipe et al. |
| 5,986,796 | A | 11/1999 | Miles |
| 6,008,785 | A | 12/1999 | Hewlett et al. |
| 6,037,922 | A | 3/2000 | Yagyu |
| 6,040,937 | A | 3/2000 | Miles |
| 6,055,090 | A | 4/2000 | Miles |
| 6,151,167 | A | 11/2000 | Melville |
| 6,201,633 | B1 | 3/2001 | Peeters et al. |
| 6,245,590 | B1 | 6/2001 | Wine et al. |
| 6,324,007 | B1 | 11/2001 | Melville |
| 6,327,071 | B1 | 12/2001 | Kimura |
| 6,356,254 | B1 | 3/2002 | Kimura |
| 6,362,912 | B1 | 3/2002 | Lewis et al. |
| 6,433,907 | B1 | 8/2002 | Lippert et al. |
| 6,507,330 | B1 | 1/2003 | Handschy et al. |
| 6,507,331 | B1 | 1/2003 | Schlangen et al. |
| 6,522,794 | B1 | 2/2003 | Bischel et al. |
| 6,543,286 | B2 | 4/2003 | Garverick et al. |
| 6,574,033 | B1 | 6/2003 | Chui et al. |
| 6,636,187 | B2 | 10/2003 | Tajima et al. |
| 6,674,562 | B1 | 1/2004 | Miles et al. |
| 6,680,792 | B2 | 1/2004 | Miles |
| 6,762,873 | B1 | 7/2004 | Coker et al. |
| 6,775,047 | B1 | 8/2004 | Leung et al. |
| 6,792,293 | B1 | 9/2004 | Awan et al. |
| 6,853,418 | B2 | 2/2005 | Suzuki et al. |
| 6,862,141 | B2 | 3/2005 | Olczak |
| 6,867,896 | B2 | 3/2005 | Miles |
| 6,972,881 | B1 | 12/2005 | Bassetti |
| 7,006,276 | B2 | 2/2006 | Starkweather et al. |
| 7,034,783 | B2 | 4/2006 | Gates et al. |
| 7,072,093 | B2 | 7/2006 | Piehl et al. |
| 7,110,158 | B2 | 9/2006 | Miles |
| 7,123,216 | B1 | 10/2006 | Miles |
| 7,161,728 | B2 | 1/2007 | Sampsell et al. |
| 7,291,363 | B2 | 11/2007 | Miller |
| 7,327,510 | B2 | 2/2008 | Cummings et al. |
| 7,366,393 | B2 | 4/2008 | Cassarly et al. |
| 7,389,476 | B2 | 6/2008 | Senda et al. |
| 7,400,489 | B2 | 7/2008 | Van Brocklin et al. |
| 7,499,208 | B2 | 3/2009 | Mignard |
| 7,515,147 | B2 | 4/2009 | Mignard |
| 7,532,195 | B2 | 5/2009 | Sampsell |
| 7,532,385 | B2 | 5/2009 | Lin et al. |
| 7,545,550 | B2 | 6/2009 | Gally et al. |
| 7,560,299 | B2 | 7/2009 | Cummings |
| 7,602,375 | B2 | 10/2009 | Chui et al. |
| 2001/0034075 | A1 | 10/2001 | Onoya |
| 2001/0040536 | A1 | 11/2001 | Tajima et al. |
| 2001/0052887 | A1 | 12/2001 | Tsutsui et al. |
| 2002/0012159 | A1 | 1/2002 | Tew |
| 2002/0015215 | A1 | 2/2002 | Miles |
| 2002/0024711 | A1 | 2/2002 | Miles |
| 2002/0054424 | A1 | 5/2002 | Miles et al. |
| 2002/0075555 | A1 | 6/2002 | Miles |
| 2002/0093722 | A1 | 7/2002 | Chan et al. |
| 2002/0190940 | A1 | 12/2002 | Itoh et al. |
| 2003/0020699 | A1 | 1/2003 | Nakatani et al. |
| 2003/0030608 | A1 | 2/2003 | Kurumisawa et al. |
| 2003/0112507 | A1 | 6/2003 | Divelbiss et al. |
| 2003/0122773 | A1 | 7/2003 | Washio et al. |
| 2003/0123125 | A1 | 7/2003 | Little |
| 2003/0137215 | A1 | 7/2003 | Cabuz |
| 2003/0137521 | A1 | 7/2003 | Zehner et al. |
| 2003/0164814 | A1 | 9/2003 | Starkweather et al. |
| 2004/0021658 | A1 | 2/2004 | Chen |
| 2004/0080516 | A1 | 4/2004 | Kurumisawa et al. |
| 2004/0136596 | A1 | 7/2004 | Oneda et al. |
| 2004/0145553 | A1 | 7/2004 | Sala et al. |
| 2004/0263502 | A1 | 12/2004 | Dallas et al. |
| 2005/0024301 | A1 | 2/2005 | Funston |
| 2005/0174340 | A1 | 8/2005 | Jones |
| 2005/0264472 | A1 | 12/2005 | Rast |
| 2006/0044291 | A1 | 3/2006 | Willis |
| 2006/0044523 | A1 | 3/2006 | Teijido et al. |
| 2006/0057754 | A1 | 3/2006 | Cummings |
| 2006/0066559 | A1 | 3/2006 | Chui et al. |
| 2007/0285385 | A1 | 12/2007 | Albert et al. |
| 2009/0273596 | A1 | 11/2009 | Cummings |

FOREIGN PATENT DOCUMENTS

| | | |
|---|---|---|
| EP | 0 911 794 | 4/1999 |
| EP | 1 134 721 | 9/2001 |
| EP | 1 239 448 | 9/2002 |
| EP | 1 280 129 | 1/2003 |
| EP | 1 414 011 | 4/2004 |
| JP | 63-055590 | 3/1988 |
| JP | 2000-075963 | 4/2000 |
| JP | 2002-072974 | 3/2002 |
| JP | 2003-058134 | 2/2003 |
| JP | 2004-145286 | 5/2004 |
| KR | 10-1990-0014917 | 10/1990 |
| KR | 10-1997-0004635 | 1/1997 |
| KR | 10-1999-0007149 | 1/1999 |
| TW | 546672 | 8/2003 |
| TW | 552720 | 9/2003 |
| WO | WO 02/089103 | 11/2002 |
| WO | WO 03/079323 | 9/2003 |
| WO | WO 2004/054088 | 6/2004 |

OTHER PUBLICATIONS

Office Action dated Jul. 11, 2011 in U.S. Appl. No. 12/851,523.
Office Action dated Sep. 25, 2009 in Chinese App. No. 200580028766.X.
Office Action dated Jan. 28, 2011, in U.S. Appl. No. 11/234,061.
Office Action dated Jan. 7, 2011 in U.S. Appl. No. 12/851,523.
Notice of Reasons for Rejection dated Feb. 23, 2010 in Japanese App. No. 2005-226224.
Office Action dated Apr. 14, 2010 in U.S. Appl. No. 11/234,061.
Chen et al., Low peak current driving scheme for passive matrix-OLED, SID International Symposium Digest of Technical Papers, May 2003, pp. 504-507.
Miles, MEMS-based interferometric modulator for display applications, Part of the SPIE Conference on Micromachined Devices and Components, vol. 3876, pp. 20-28 (1999).
Miles et al., 5.3: Digital Paper™: Reflective displays using interferometric modulation, SID Digest, vol. XXXI, 2000 pp. 32-35.
Office Action dated Dec. 11, 2007 in U.S. Appl. No. 11/159,073.
Office Action dated Jun. 15, 2007 in U.S. Appl. No. 11/159,073.
Office Action dated Mar. 10, 2008 in U.S. Appl. No. 11/159,073.
Office Action dated Sep. 18, 2008 in U.S. Appl. No. 11/159,073.
ISR and WO for PCT/US05/029796 filed Aug. 23, 2005.
IPRP for PCT/US05/029796 filed Aug. 23, 2005.
Office Action dated Jun. 20, 2008 in Chinese App. No. 200580028766.X.
Office Action dated Feb. 11, 2008 in U.S. Appl. No. 11/100,762.
Office Action dated Oct. 8, 2008 in U.S. Appl. No. 11/234,061.
Partial Search Report dated May 7, 2008 for European App. No. 05255639.6.
Extended Search Report dated Aug. 11, 2008 for European App. No. 05255639.6.
Office Action dated May 9, 2008 in Chinese App. No. 200510103441.5.
Official Action dated Jul. 10, 2009 in European App. No. 05790203.3.
Office Action dated Aug. 11, 2008 in U.S. Appl. No. 11/100,762.
Office Action dated Dec. 4, 2008 in U.S. Appl. No. 11/100,762.
Office Action dated Apr. 30, 2009 in U.S. Appl. No. 11/234,061.
Office Action dated Sep. 18, 2009 in U.S. Appl. No. 11/234,061.
Office Action dated Apr. 3, 2009 in Chinese App. No. 200510103441.5.
Notice of Reasons for Rejection dated Sep. 29, 2009 in Japanese App. No. 2005-226224.
Office Action dated Dec. 30, 2011, in U.S. Appl. No. 11/234,061.
Office Action dated Dec. 23, 2011 in U.S. Appl. No. 12/851,523.

Notice to Sumbit a Response dated Nov. 30, 2011 in Korean App. No. 10-2005-0084146.
Office Action dated Nov. 23, 2011 in Taiwanese App. No. 094130567.
Notice of Reasons for Rejection dated Jul. 10, 2012 in Japanese App. No. 2010-228486.
Official Communication dated Sep. 28, 2012 for European App. No. 05255639.6.

| | | Column Output Signals | |
|---|---|---|---|
| | | $+V_{bias}$ | $-V_{bias}$ |
| Row Output Signals | 0 | Stable | Stable |
| | $+\Delta V$ | Release | Actuate |
| | $-\Delta V$ | Actuate | Release |

APPARATUS AND SYSTEM FOR WRITING DATA TO ELECTROMECHANICAL DISPLAY ELEMENTS

CROSS REFERENCE TO RELATED APPLICATIONS

This application is a continuation-in-part of U.S. patent application Ser. No. 11/100,762, entitled "Method and System for Writing Data to MEMS Display Elements," filed Apr. 6, 2005, now issued as U.S. Pat. No. 7,602,375; which claims the benefit of U.S. Provisional Application No. 60/613,483, entitled "Method and Device for Driving Interferometric Modulators," filed Sep. 27, 2004. The entire disclosure of each of the above-referenced applications is hereby incorporated by reference in its entirety.

This application is a continuation of U.S. patent application Ser. No. 11/234,061, entitled "Method and System for Writing Data to MEMS Display Elements," filed Sep. 22, 2005; which is a continuation-in-part of U.S. patent application Ser. No. 11/100,762, entitled "Method and System for Writing Data to MEMS Display Elements," filed Apr. 6, 2005, now issued as U.S. Pat. No. 7,602,375, and which claims the benefit of U.S. Provisional Application No. 60/613,419, entitled "Method and Device for Driving Interferometric Modulators with Hysteresis," filed Sep. 27, 2004, and the benefit of U.S. Provisional Application 60/613,483, entitled "Method and Device for Driving Interferometric Modulators," filed Sep. 27, 2004. The entire disclosure of each of the above-referenced applications is hereby incorporated by reference in its entirety.

BACKGROUND

Microelectromechanical systems (MEMS) include micro mechanical elements, actuators, and electronics. Micromechanical elements may be created using deposition, etching, and or other micromachining processes that etch away parts of substrates and/or deposited material layers or that add layers to form electrical and electromechanical devices. One type of MEMS device is called an interferometric modulator. An interferometric modulator may comprise a pair of conductive plates, one or both of which may be transparent and/or reflective in whole or part and capable of relative motion upon application of an appropriate electrical signal. One plate may comprise a stationary layer deposited on a substrate, the other plate may comprise a metallic membrane separated from the stationary layer by an air gap. Such devices have a wide range of applications, and it would be beneficial in the art to utilize and/or modify the characteristics of these types of devices so that their features can be exploited in improving existing products and creating new products that have not yet been developed.

SUMMARY

The system, method, and devices of the invention each have several aspects, no single one of which is solely responsible for its desirable attributes. Without limiting the scope of this invention, its more prominent features will now be discussed briefly. After considering this discussion, and particularly after reading the section entitled "Detailed Description of Certain Embodiments" one will understand how the features of this invention provide advantages over other display devices.

In one embodiment, an apparatus for displaying images is provided, wherein the apparatus comprises an electromechanical display element comprising at least a portion of an array of electromechanical display elements, a column driver configured to assert a voltage on one or more columns of the array, and a row driver configured to pulse one or more rows of the array with a voltage. The column driver and row driver are configured to apply a plurality of potential differences across the electromechanical display element during a display write process. The column and row driver are configured to write display data to the electromechanical display element with a first potential difference of a first polarity during a first portion of the display write process, to re-write the display data to the electromechanical display element with a second potential difference having a polarity opposite the first polarity during a second portion of the display write process, to apply a third potential difference having the first polarity to the electromechanical display element during a third portion of the display write process, and to apply a fourth potential difference having the opposite polarity to the electromechanical display element during a fourth portion of the display write process. A state of the electromechanical display element does not change during the third and fourth portions of the display write process.

In another embodiment, an apparatus for actuating an electromechanical display element is provided, wherein the electromechanical display element comprises a portion of an array of electromechanical display elements. The apparatus comprises means for writing display data to the electromechanical display element with a potential difference of a first polarity during a first portion of a display write process, means for re-writing the display data to the electromechanical display element with a potential difference having a polarity opposite the first polarity during a second portion of the display write process, means for applying a first bias potential having the first polarity to the electromechanical display element during a third portion of the display write process, and means for applying a second bias potential having the opposite polarity to the electromechanical display element during a fourth portion of the display write process. A state of the electromechanical display element does not change during the third and fourth portions. The means for writing, means for re-writing, means for applying a first bias potential, or means for applying a second bias potential may each comprise a column driver circuit configured to assert a voltage on one or more columns of the array of electromechanical display elements. The means for writing, means for re-writing, means for applying a first bias potential, and means for applying a second bias potential may each comprise a row driver circuit configured to pulse one or more rows of the array of electromechanical display elements with a voltage.

In still another embodiment, a system for writing frames of display data is provided, wherein the system comprises an array of electromechanical display elements and an array controller comprising a column driver and a row driver. The column driver is configured to assert a potential on one or more columns of the array, and the row driver is configured to pulse one or more rows of the array with a potential. The array controller is configured to write display data to the electromechanical display elements, where the writing requires less than a defined frame update period. The array controller is further configured to apply a series of bias potentials of alternating polarity to the electromechanical display elements for the remainder of the frame update period. A state of the electromechanical display elements does not change during the remainder.

In yet another embodiment, an apparatus for writing frames of display data to an array of electromechanical display elements at a rate of one frame per defined frame update period is provided. The apparatus comprises means for writing display data to the electromechanical display elements, wherein the writing takes less than the frame update period. The apparatus further comprises for applying a series of bias potentials of alternating polarity to the electromechanical display elements for the remainder of the frame update period. A state of the electromechanical display elements does not change during the remainder. The means for writing or the means for applying may comprise an array controller configured to provide signals to the array.

In another embodiment, a device for driving display elements is provided, wherein the device comprises a display comprising a plurality of pixels, and a display controller configured to periodically release substantially all pixels of the display. The display controller is configured to periodically release each pixel at an infrequent rate such that there is no perceptible effect on visual appearance of the display to a normal observer.

DETAILED DESCRIPTION OF PREFERRED EMBODIMENTS

The following detailed description is directed to certain specific embodiments of the invention. However, the invention can be embodied in a multitude of different ways. In this description, reference is made to the drawings wherein like parts are designated with like numerals throughout. As will be apparent from the following description, the invention may be implemented in any device that is configured to display an image, whether in motion (e.g., video) or stationary (e.g., still image), and whether textual or pictorial. More particularly, it is contemplated that the invention may be implemented in or associated with a variety of electronic devices such as, but not limited to, mobile telephones, wireless devices, personal data assistants (PDAs), hand-held or portable computers, GPS receivers/navigators, cameras, MP3 players, camcorders, game consoles, wrist watches, clocks, calculators, television monitors, flat panel displays, computer monitors, auto displays (e.g., odometer display, etc.), cockpit controls and/or displays, display of camera views (e.g., display of a rear view camera in a vehicle), electronic photographs, electronic billboards or signs, projectors, architectural structures, packaging, and aesthetic structures (e.g., display of images on a piece of jewelry). MEMS devices of similar structure to those described herein can also be used in non-display applications such as in electronic switching devices.

Figure 1:
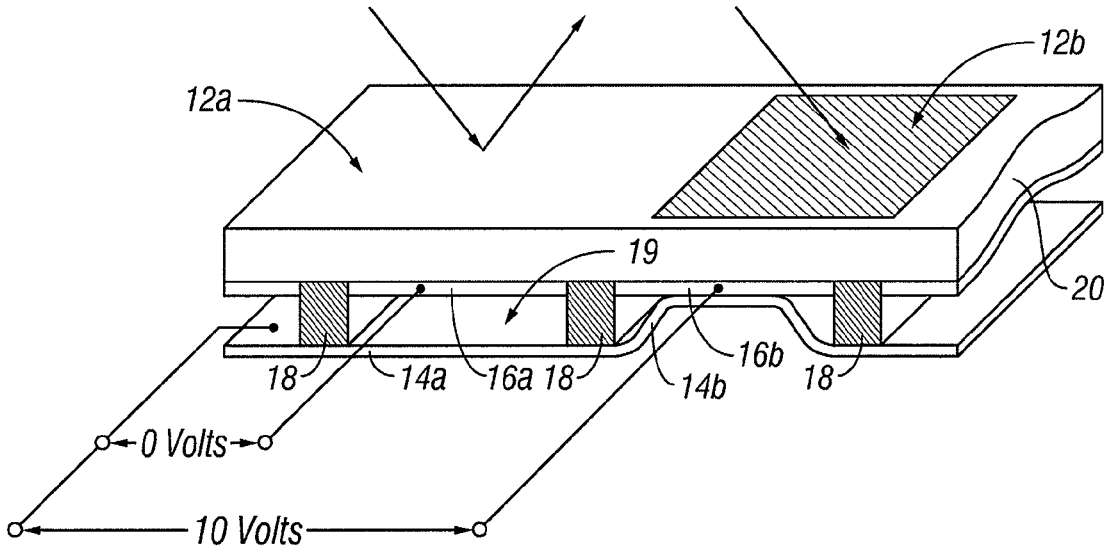
FIG. 1 is an isometric view depicting a portion of one embodiment of an interferometric modulator display in which a movable reflective layer of a first interferometric modulator is in a released position and a movable reflective layer of a second interferometric modulator is in an actuated position.

One interferometric modulator display embodiment comprising an interferometric MEMS display element is illustrated in FIG. 1. In these devices, the pixels are in either a bright or dark state. In the bright ("on" or "open") state, the display element reflects a large portion of incident visible light to a user. When in the dark ("off" or "closed") state, the display element reflects little incident visible light to the user. Depending on the embodiment, the light reflectance properties of the "on" and "off" states may be reversed. MEMS pixels can be configured to reflect predominantly at selected colors, allowing for a color display in addition to black and white.

FIG. 1 is an isometric view depicting two adjacent pixels in a series of pixels of a visual display, wherein each pixel comprises a MEMS interferometric modulator. In some embodiments, an interferometric modulator display comprises a row/column array of these interferometric modulators. Each interferometric modulator includes a pair of reflective layers positioned at a variable and controllable distance from each other to form a resonant optical cavity with at least one variable dimension. In one embodiment, one of the reflective layers may be moved between two positions. In the first position, referred to herein as the released state, the movable layer is positioned at a relatively large distance from a fixed partially reflective layer. In the second position, the movable layer is positioned more closely adjacent to the partially reflective layer. Incident light that reflects from the two layers interferes constructively or destructively depending on the position of the movable reflective layer, producing either an overall reflective or non-reflective state for each pixel.

The depicted portion of the pixel array in FIG. 1 includes two adjacent interferometric modulators 12*a* and 12*b*. In the interferometric modulator 12*a* on the left, a movable and highly reflective layer 14*a* is illustrated in a released position at a predetermined distance from a fixed partially reflective layer 16*a*. In the interferometric modulator 12*b* on the right, the movable highly reflective layer 14*b* is illustrated in an actuated position adjacent to the fixed partially reflective layer 16*b*.

The fixed layers 16*a*, 16*b* are electrically conductive, partially transparent and partially reflective, and may be fabricated, for example, by depositing one or more layers each of chromium and indium-tin-oxide onto a transparent substrate 20. The layers are patterned into parallel strips, and may form row electrodes in a display device as described further below. The movable layers 14*a*, 14*b* may be formed as a series of parallel strips of a deposited metal layer or layers (orthogonal to the row electrodes 16*a*, 16*b*) deposited on top of posts 18 and an intervening sacrificial material deposited between the posts 18. When the sacrificial material is etched away, the deformable metal layers are separated from the fixed metal layers by a defined air gap 19. A highly conductive and reflective material such as aluminum may be used for the deformable layers, and these strips may form column electrodes in a display device.

With no applied voltage, the cavity 19 remains between the layers 14*a*, 16*a* and the deformable layer is in a mechanically relaxed state as illustrated by the pixel 12*a* in FIG. 1. However, when a potential difference is applied to a selected row and column, the capacitor formed at the intersection of the row and column electrodes at the corresponding pixel becomes charged, and electrostatic forces pull the electrodes together. If the voltage is high enough, the movable layer is deformed and is forced against the fixed layer (a dielectric material which is not illustrated in this Figure may be deposited on the fixed layer to prevent shorting and control the separation distance) as illustrated by the pixel 12*b* on the right in FIG. 1. The behavior is the same regardless of the polarity of the applied potential difference. In this way, row/column actuation that can control the reflective vs. non-reflective pixel states is analogous in many ways to that used in conventional LCD and other display technologies.

Figure 2:
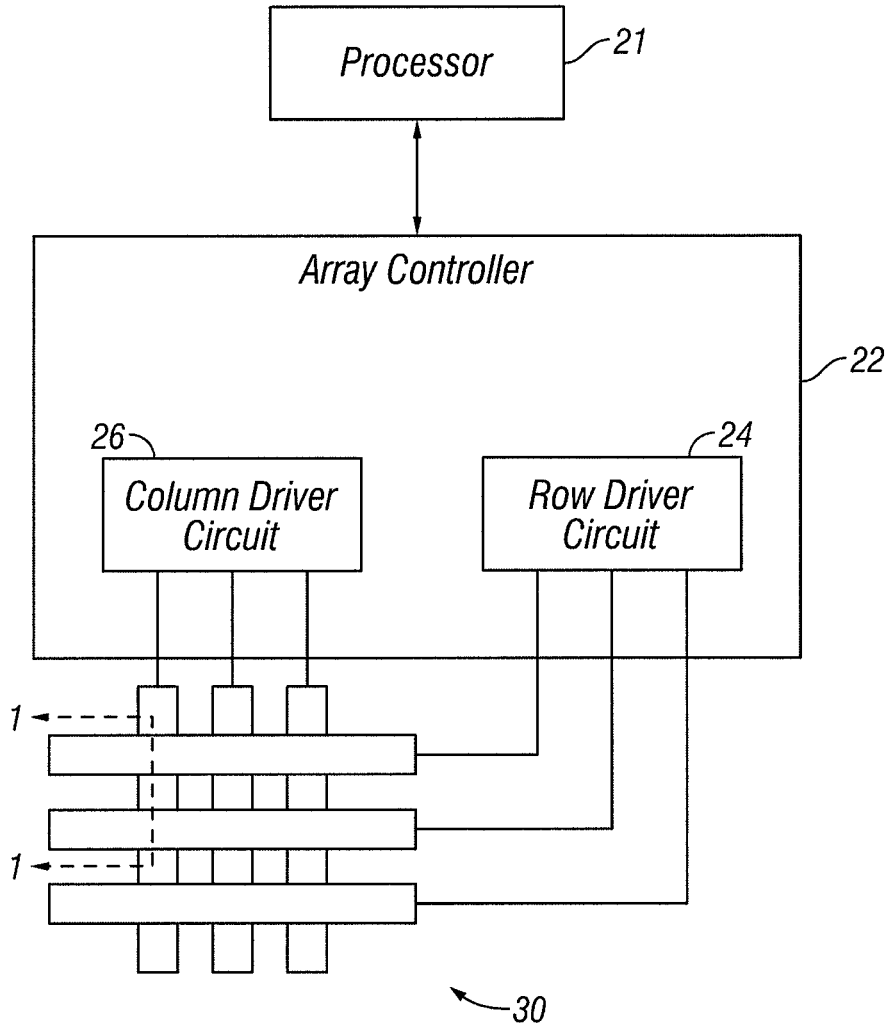
FIG. 2 is a system block diagram illustrating one embodiment of an electronic device incorporating a 3×3 interferometric modulator display.

FIGS. 2 through 5 illustrate one exemplary process and system for using an array of interferometric modulators in a display application. FIG. 2 is a system block diagram illustrating one embodiment of an electronic device that may incorporate aspects of the invention. In the exemplary embodiment, the electronic device includes a processor 21 which may be any general purpose single- or multi-chip microprocessor such as an ARM, Pentium®, Pentium II®, Pentium III®, Pentium IV®, Pentium® Pro, an 8051, a MIPS®, a Power PC®, an ALPHA®, or any special purpose microprocessor such as a digital signal processor, microcontroller, or a programmable gate array. As is conventional in the art, the processor 21 may be configured to execute one or more software modules. In addition to executing an operating system, the processor may be configured to execute one or more software applications, including a web browser, a telephone application, an email program, or any other software application.

In one embodiment, the processor 21 is also configured to communicate with an array controller 22. In one embodiment, the array controller 22 includes a row driver circuit 24 and a column driver circuit 26 that provide signals to a pixel array 30. The cross section of the array illustrated in FIG. 1 is shown by the lines 1-1 in FIG. 2. For MEMS interferometric modulators, the row/column actuation protocol may take advantage of a hysteresis property of these devices illustrated in FIG. 3. It may require, for example, a 10 volt potential difference to cause a movable layer to deform from the released state to the actuated state. However, when the voltage is reduced from that value, the movable layer maintains its state as the voltage drops back below 10 volts. In the exemplary embodiment of FIG. 3, the movable layer does not release completely until the voltage drops below 2 volts. There is thus a range of voltage, about 3 to 7 V in the example illustrated in FIG. 3, where there exists a window of applied voltage within which the device is stable in either the released or actuated state. This is referred to herein as the "hysteresis window" or "stability window." For a display array having the hysteresis characteristics of FIG. 3, the row/column actuation protocol can be designed such that during row strobing, pixels in the strobed row that are to be actuated are exposed to a voltage difference of about 10 volts, and pixels that are to be released are exposed to a voltage difference of close to zero volts. After the strobe, the pixels are exposed to a steady state voltage difference of about 5 volts such that they remain in whatever state the row strobe put them in. After being written, each pixel sees a potential difference within the "stability window" of 3-7 volts in this example. This feature makes the pixel design illustrated in FIG. 1 stable under the same applied voltage conditions in either an actuated or released pre-existing state. Since each pixel of the interferometric modulator, whether in the actuated or released state, is essentially a capacitor formed by the fixed and moving reflective layers, this stable state can be held at a voltage within the hysteresis window with almost no power dissipation. Essentially no current flows into the pixel if the applied potential is fixed.

In typical applications, a display frame may be created by asserting the set of column electrodes in accordance with the desired set of actuated pixels in the first row. A row pulse is then applied to the row 1 electrode, actuating the pixels corresponding to the asserted column lines. The asserted set of column electrodes is then changed to correspond to the desired set of actuated pixels in the second row. A pulse is then applied to the row 2 electrode, actuating the appropriate pixels in row 2 in accordance with the asserted column electrodes. The row 1 pixels are unaffected by the row 2 pulse, and remain in the state they were set to during the row 1 pulse. This may be repeated for the entire series of rows in a sequential fashion to produce the frame. Generally, the frames are refreshed and/or updated with new display data by continually repeating this process at some desired number of frames per second. A wide variety of protocols for driving row and column electrodes of pixel arrays to produce display frames are also well known and may be used in conjunction with the present invention.

Figures 3, 4:
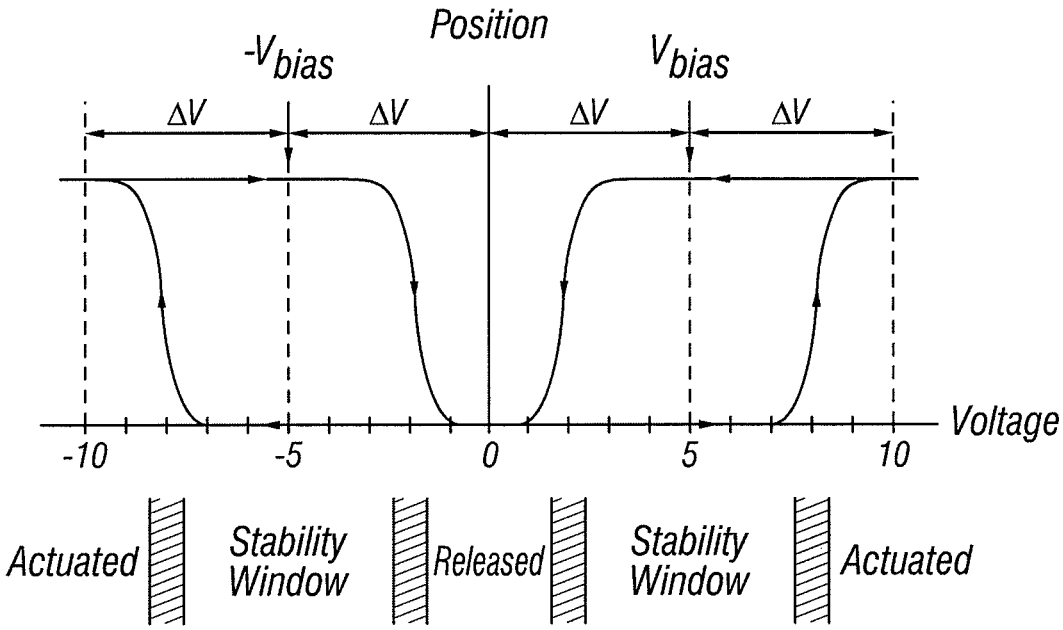
FIG. 3 is a diagram of movable mirror position versus applied voltage for one exemplary embodiment of an interferometric modulator of FIG. 1.
FIG. 4 is an illustration of a set of row and column voltages that may be used to drive an interferometric modulator display.

FIGS. 4 and 5 illustrate one possible actuation protocol for creating a display frame on the 3×3 array of FIG. 2. FIG. 4 illustrates a possible set of column and row voltage levels that may be used for pixels exhibiting the hysteresis curves of FIG. 3. In the FIG. 4 embodiment, actuating a pixel involves setting the appropriate column to $-V_{bias}$, and the appropriate row to $+\Delta V$, which may correspond to −5 volts and +5 volts respectively Releasing the pixel is accomplished by setting the appropriate column to $+V_{bias}$, and the appropriate row to the same $+\Delta V$, producing a zero volt potential difference across the pixel. In those rows where the row voltage is held at zero volts, the pixels are stable in whatever state they were originally in, regardless of whether the column is at $+V_{bias}$, or $-V_{bias}$. As is also illustrated in FIG. 4, it will be appreciated that voltages of opposite polarity than those described above can be used, e.g., actuating a pixel can involve setting the appropriate column to $+V_{bias}$, and the appropriate row to $-\Delta V$. In this embodiment, releasing the pixel is accomplished by setting the appropriate column to $-V_{bias}$, and the appropriate row to the same $-\Delta V$, producing a zero volt potential difference across the pixel.

Figure 5A:
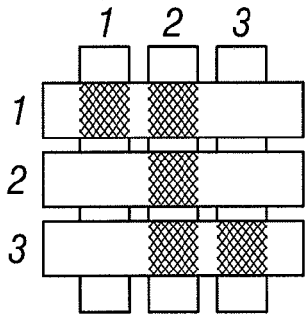
FIGS. 5A and 5B illustrate one exemplary timing diagram for row and column signals that may be used to write a frame of display data to the 3×3 interferometric modulator display of FIG. 2.
Figure 5B:
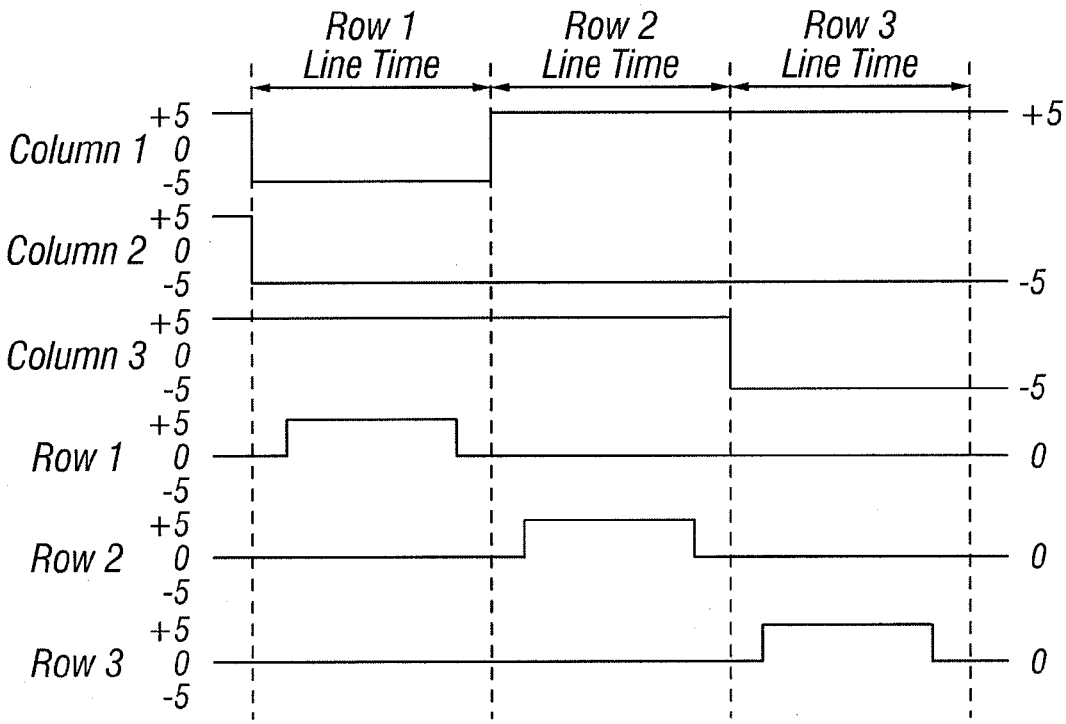

FIG. 5B is a timing diagram showing a series of row and column signals applied to the 3×3 array of FIG. 2 which will result in the display arrangement illustrated in FIG. 5A, where actuated pixels are non-reflective. Prior to writing the frame illustrated in FIG. 5A, the pixels can be in any state, and in this example, all the rows are at 0 volts, and all the columns are at +5 volts. With these applied voltages, all pixels are stable in their existing actuated or released states.

In the FIG. 5A frame, pixels (1,1), (1,2), (2,2), (3,2) and (3,3) are actuated. To accomplish this, during a "line time" for row 1, columns 1 and 2 are set to −5 volts, and column 3 is set to +5 volts. This does not change the state of any pixels, because all the pixels remain in the 3-7 volt stability window.

Row 1 is then strobed with a pulse that goes from 0, up to 5 volts, and back to zero. This actuates the (1,1) and (1,2) pixels and releases the (1,3) pixel. No other pixels in the array are affected. To set row 2 as desired, column 2 is set to −5 volts, and columns 1 and 3 are set to +5 volts. The same strobe applied to row 2 will then actuate pixel (2,2) and release pixels (2,1) and (2,3). Again, no other pixels of the array are affected. Row 3 is similarly set by setting columns 2 and 3 to −5 volts, and column 1 to +5 volts. The row 3 strobe sets the row 3 pixels as shown in FIG. 5A. After writing the frame, the row potentials are zero, and the column potentials can remain at either +5 or −5 volts, and the display is then stable in the arrangement of FIG. 5A. It will be appreciated that the same procedure can be employed for arrays of dozens or hundreds of rows and columns. It will also be appreciated that the timing, sequence, and levels of voltages used to perform row and column actuation can be varied widely within the general principles outlined above, and the above example is exemplary only, and any actuation voltage method can be used with the present invention.

Figure 6A:
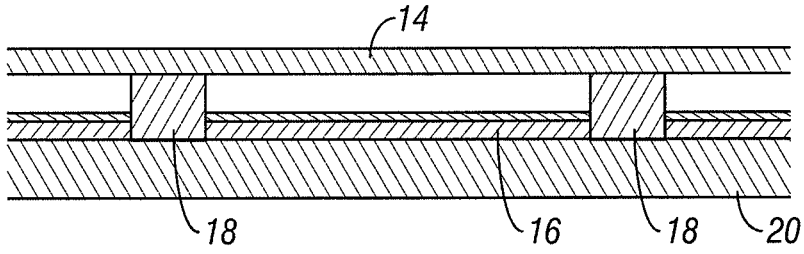
FIG. 6A is a cross section of the device of FIG. 1.
Figure 6B:
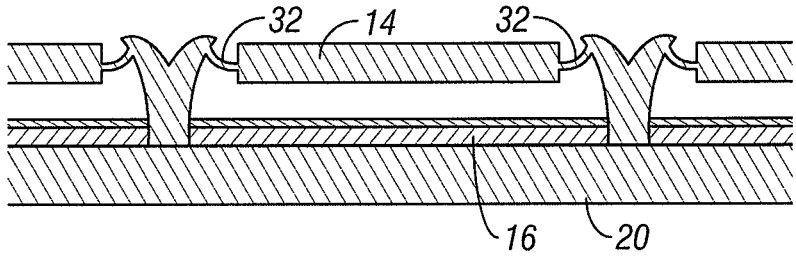
FIG. 6B is a cross section of an alternative embodiment of an interferometric modulator.
Figure 6C:
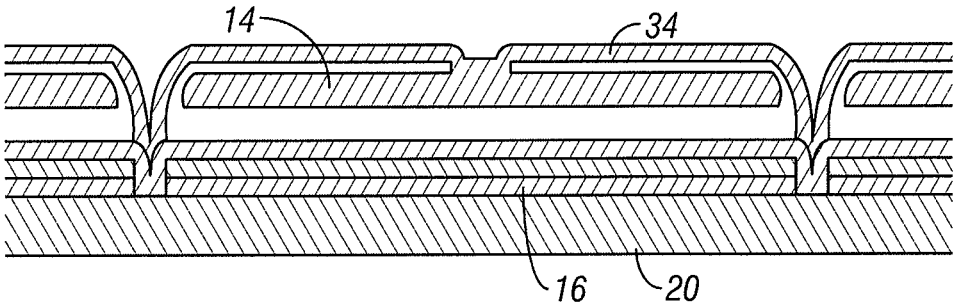
FIG. 6C is a cross section of another alternative embodiment of an interferometric modulator.

The details of the structure of interferometric modulators that operate in accordance with the principles set forth above may vary widely. For example, FIGS. 6A-6C illustrate three different embodiments of the moving mirror structure. FIG. 6A is a cross section of the embodiment of FIG. 1, where a strip of metal material 14 is deposited on orthogonally extending supports 18. In FIG. 6B, the moveable reflective material 14 is attached to supports at the corners only, on tethers 32. In FIG. 6C, the moveable reflective material 14 is suspended from a deformable layer 34. This embodiment has benefits because the structural design and materials used for the reflective material 14 can be optimized with respect to the optical properties, and the structural design and materials used for the deformable layer 34 can be optimized with respect to desired mechanical properties. The production of various types of interferometric devices is described in a variety of published documents, including, for example, U.S. Published Application 2004/0051929. A wide variety of well known techniques may be used to produce the above described structures involving a series of material deposition, patterning, and etching steps.

It is one aspect of the above described devices that charge can build on the dielectric between the layers of the device, especially when the devices are actuated and held in the actuated state by an electric field that is always in the same direction. For example, if the moving layer is always at a higher potential relative to the fixed layer when the device is actuated by potentials having a magnitude larger than the outer threshold of stability, a slowly increasing charge buildup on the dielectric between the layers can begin to shift the hysteresis curve for the device. This is undesirable as it causes display performance to change over time, and in different ways for different pixels that are actuated in different ways over time. As can be seen in the example of FIG. 5B, a given pixel sees a 10 volt difference during actuation, and every time in this example, the row electrode is at a 10 V higher potential than the column electrode. During actuation, the electric field between the plates therefore always points in one direction, from the row electrode toward the column electrode.

This problem can be reduced by actuating the MEMS display elements with a potential difference of a first polarity during a first portion of the display write process, and actuating the MEMS display elements with a potential difference having a polarity opposite the first polarity during a second portion of the display write process. This basic principle is illustrated in FIGS. 7, 8A, and 8B.

Figure 7:
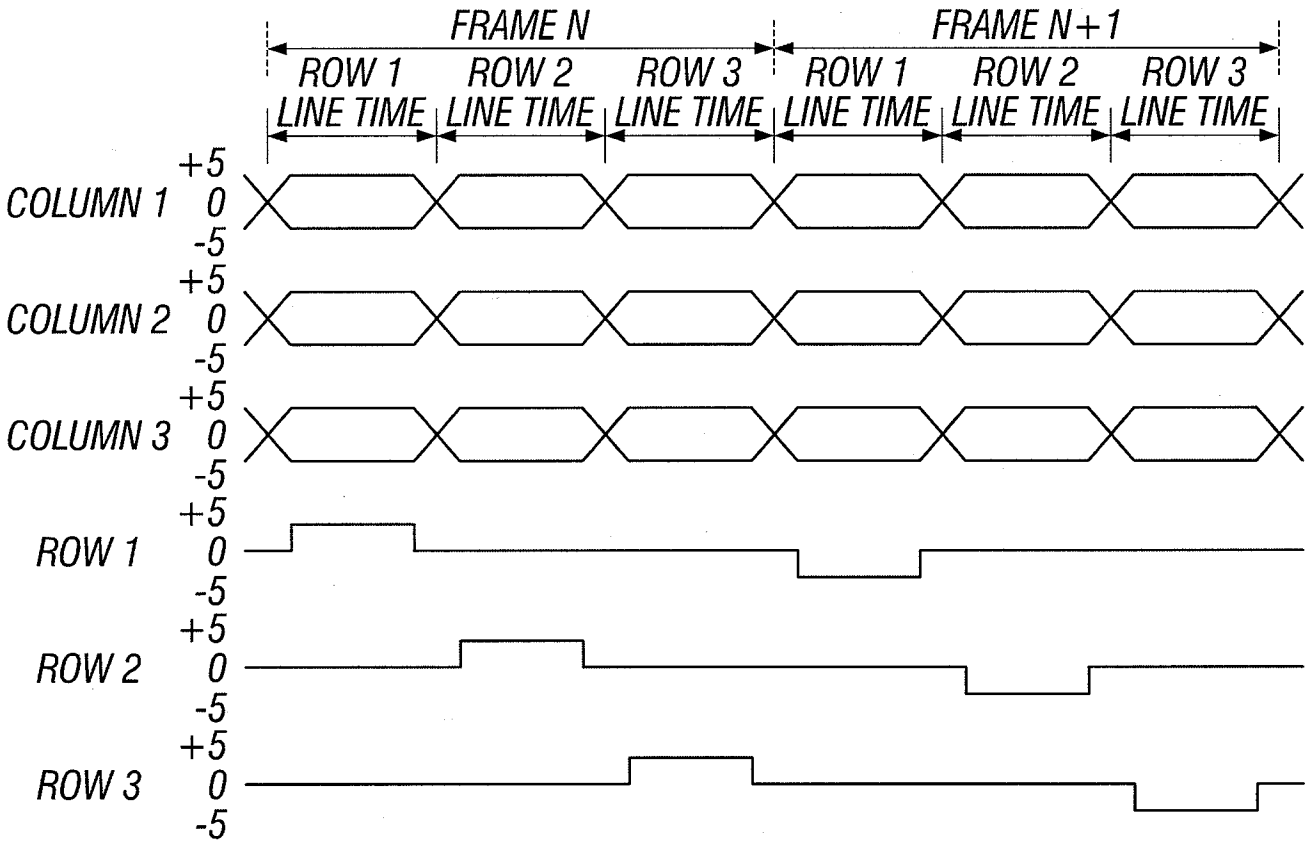
FIG. 7 is a timing diagram illustrating application of opposite write polarities to different frames of display data.

In FIG. 7, two frames of display data are written in sequence, frame N and frame N+1. In this Figure, the data for the columns goes valid for row 1 (i.e., either +5 or −5 depending on the desired state of the pixels in row 1) during the row 1 line time, valid for row 2 during the row 2 line time, and valid for row 3 during the row 3 line time. Frame N is written as shown in FIG. 5B, which will be termed positive polarity herein, with the row electrode 10 V above the column electrode during MEMS device actuation. During actuation, the column electrode may be at −5 V, and the scan voltage on the row is +5 V in this example. The actuation and release of display elements for Frame N is thus performed according to the center row of FIG. 4 above.

Frame N+1 is written in accordance with the lowermost row of FIG. 4. For Frame N+1, the scan voltage is −5 V, and the column voltage is set to +5 V to actuate, and −5 V to release. Thus, in Frame N+1, the column voltage is 10 V above the row voltage, termed a negative polarity herein. As the display is continually refreshed and/or updated, the polarity can be alternated between frames, with Frame N+2 being written in the same manner as Frame N, Frame N+3 written in the same manner as Frame N+1, and so on. In this way, actuation of pixels takes place in both polarities. In embodiments following this principle, potentials of opposite polarities are respectively applied to a given MEMS element at defined times and for defined time durations that depend on the rate at which image data is written to MEMS elements of the array, and the opposite potential differences are each applied an approximately equal amount of time over a given period of display use. This helps reduce charge buildup on the dielectric over time.

A wide variety of modifications of this scheme can be implemented. For example, Frame N and Frame N+1 can comprise different display data. Alternatively, it can be the same display data written twice to the array with opposite polarities. One specific embodiment wherein the same data is written twice with opposite polarity signals is illustrated in additional detail in FIG. 8.

In this Figure, Frame N and N+1 update periods are illustrated. These update periods are typically the inverse of a selected frame update rate that is defined by the rate at which new frames of display data are received by the display system. This rate may, for example, be 15 Hz, 30 Hz, or another frequency depending on the nature of the image data being displayed.

Figure 8:
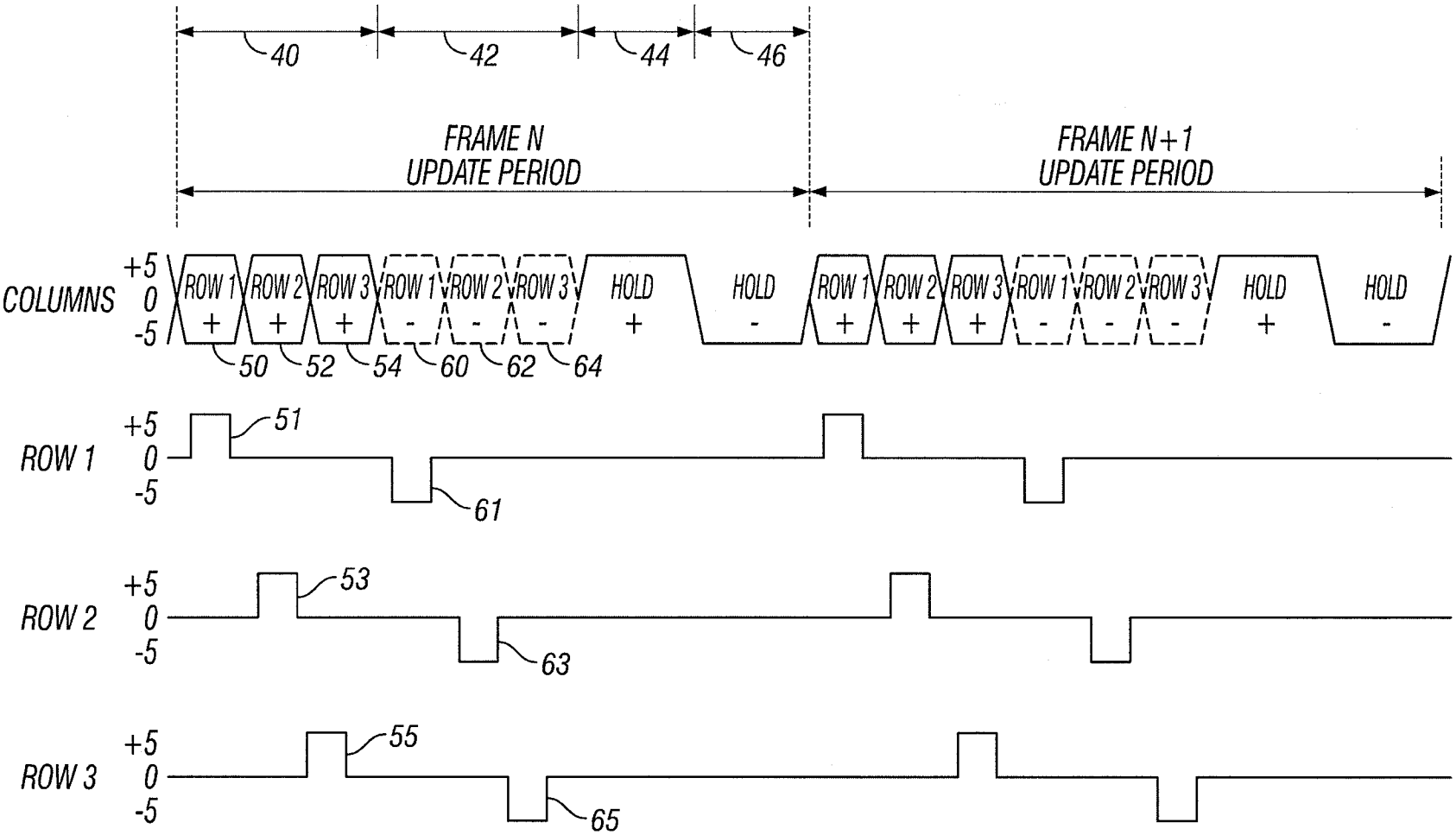
FIG. 8 is a timing diagram illustrating write and hold cycles during a frame update period in a first embodiment of the invention.

It is one feature of the display elements described herein that a frame of data can generally be written to the array of display elements in a time period shorter than the update period defined by the frame update rate. In the embodiment of FIG. 8, the frame update period is divided into four portions or intervals, designated 40, 42, 44, and 46 in FIG. 8. FIG. 8 illustrates a timing diagram for a 3 row display, such as illustrated in FIG. 5A.

During the first portion 40 of a frame update period, the frame is written with potential differences across the modulator elements of a first polarity. For example, the voltages applied to the rows and columns may follow the polarity illustrated by the center row of FIG. 4 and FIG. 5B. As with FIG. 7, in FIG. 8, the column voltages are not shown individually, but are indicated as a multi-conductor bus, where the column voltages are valid for row 1 data during period 50, are valid for row 2 data during period 52, and valid for row 3 data during period 54, wherein "valid" is a selected voltage which differs depending on the desired state of a display element in the column to be written. In the example of FIG. 5B, each column may assume a potential of +5 or −5 depending on the desired display element state. As explained above, row pulse 51 sets the state of row 1 display elements as desired, row pulse 53 sets the state of row 2 display elements as desired, and row pulse 55 sets the state of row 3 display elements as desired.

During a second portion 42 of the frame update period, the same data is written to the array with the opposite polarities applied to the display elements. During this period, the voltages present on the columns are the opposite of what they were during the first portion 40. If the voltage was, for example, +5 volts on a column during time period 50, it will be −5 volts during time period 60, and vice versa. The same is true for sequential applications of sets of display data to the columns, e.g., the potential during period 62 is opposite to that of 52, and the potential during period 64 is opposite to that applied during time period 54. Row strobes 61, 63, 65 of opposite polarity to those provided during the first portion 40 of the frame update period re-write the same data to the array during second portion 42 as was written during portion 40, but the polarity of the applied voltage across the display elements is reversed.

In the embodiment illustrated in FIG. 8, both the first period 40 and the second period 42 are complete before the end of the frame update period. In this embodiment, this time period is filled with a pair of alternating hold periods 44 and 46. Using the array of FIGS. 3-5 as an example, during the first hold period 44, the rows are all held at 0 volts, and the columns are all brought to +5 V. During the second hold period 46, the rows remain at 0 volts, and the columns are all brought to −5 V. Thus, during the period following array writing of Frame N, but before array writing of Frame N+1, bias potentials of opposite polarity are each applied to the elements of the array. During these periods, the state of the array elements does not change, but potentials of opposite polarity are applied to minimize charge buildup in the display elements.

Figure 9:
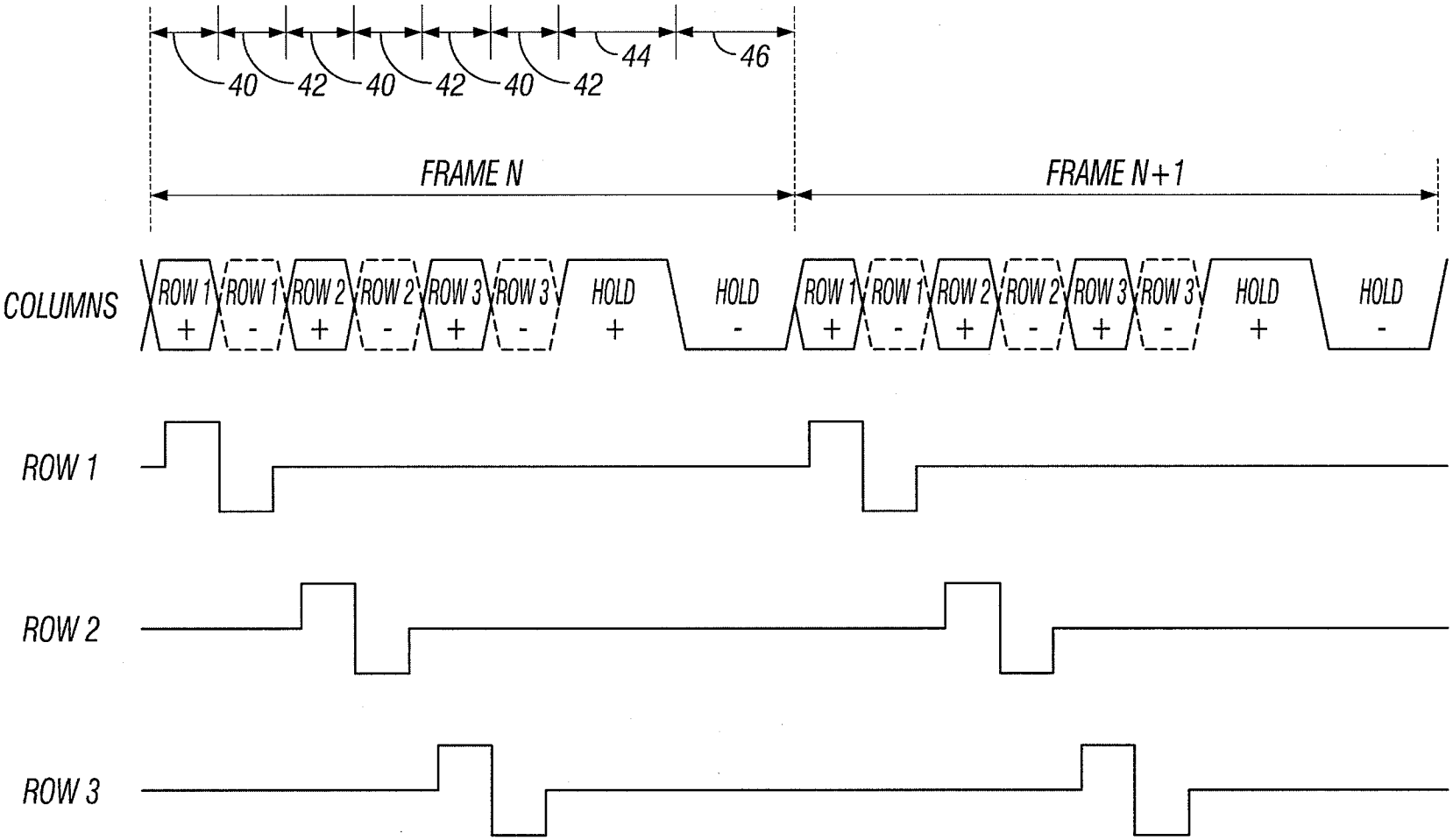
FIG. 9 is a timing diagram illustrating write and hold cycles during a frame update period in a first embodiment of the invention.

During the next frame update period for Frame N+1, the process may be repeated, as shown in FIG. 8. It will be appreciated that a variety of modifications of this overall method may be utilized to advantageous effect. For example, more than two hold periods could be provided. FIG. 9 illustrates an embodiment where the writing in opposite polarities is done on a row by row basis rather than a frame by frame basis. In this embodiment, the time periods 40 and 42 of FIG. 8 are interleaved. In addition, the modulator may be more susceptible to charging in one polarity than the other, and so although essentially exactly equal positive and negative write and hold times are usually most advantageous, it might be beneficial in some cases to skew the relative time periods of positive and negative polarity actuation and holding slightly. Thus, in one embodiment, the time of the write cycles and hold cycles can be adjusted so as to allow the charge to balance out. In an exemplary embodiment, using values selected purely for illustration and ease of arithmetic, an electrode material can have a rate of charging in positive polarity is twice as fast the rate of charging in the negative polarity. If the positive write cycle, write+, is 10 ms, the negative write cycle, write−, could be 20 ms to compensate. Thus the write+ cycle will take a third of the total write cycle, and the write− cycle will take two-thirds of the total write time. Similarly the hold cycles could have a similar time ratio. In other embodiments, the change in electric field could be non-linear, such that the rate of charge or discharge could vary over time. In this case, the cycle times could be adjusted based on the non-linear charge and discharge rates.

In some embodiments, several timing variables are independently programmable to ensure DC electric neutrality and consistent hysteresis windows. These timing settings include, but are not limited to, the write+ and write− cycle times, the positive hold and negative hold cycle times, and the row strobe time.

While the frame update cycles discussed herein have a set order of write+, write−, hold +, and hold −, this order can be changed. In other embodiments, the order of cycles can be any other permutation of the cycles. In still other embodiments, different cycles and different permutations of cycles can be used for different display update periods. For example, Frame N might include only a write+ cycle, hold+ cycle, and a hold− cycle, while subsequent Frame N+1 could include only a write−, hold+, and hold− cycle. Another embodiment could use write+, hold+, write−, hold− for one or a series of frames, and then use write−, hold−, write+, hold+ for the next subsequent one or series of frames. It will also be appreciated that the order of the positive and negative polarity hold cycles can be independently selected for each column. In this embodiment, some columns cycle through hold+ first, then hold−, while other columns go to hold− first and then to hold+. In one example, depending on the configuration of the column driver circuit, it may be more advantageous to set half the columns at −5 V and half at +5 V for the first hold cycle 44, and then switch all column polarities to set the first half to +5 V and the second half to −5 V for the second hold cycle 46.

It has also been found advantageous to periodically include a release cycle for the MEMS display elements. It is advantageous to perform this release cycle for one or more rows during some of the frame update cycles. This release cycle will typically be provided relatively infrequently, such as every 100,000 or 1,000,000 frame updates, or every hour or several hours of display operation. The purpose of this periodic releasing of all or substantially all pixels is to reduce the chance that a MEMS display element that is continually actuated for a long period due to the nature of the images being displayed will become stuck in an actuated state. In the embodiment of FIG. 8, for example, period 50 could be a write+ cycle that writes all the display elements of row 1 into a released state every 100,000 frame updates. The same may be done for all the rows of the display with periods 52, 54, and/or 60, 62, 64. Since they occur infrequently and for short periods, these release cycles may be widely spread in time (e.g. every 100,000 or more frame updates or every hour or more of display operation) and spread at different times over different rows of the display so as to eliminate any perceptible affect on visual appearance of the display to a normal observer.

Figure 10:
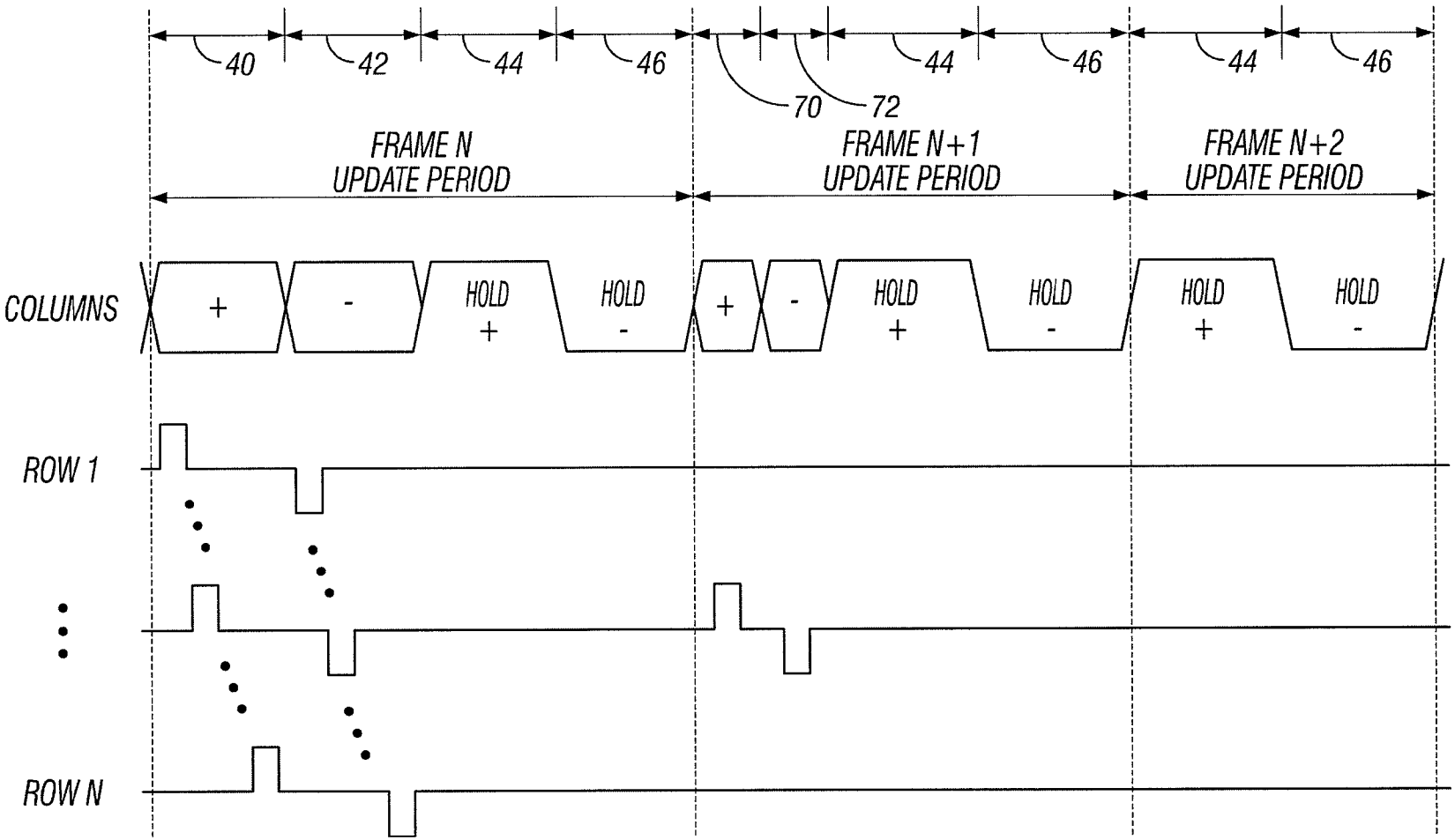
FIG. 10 is a timing diagram illustrating variable length write and hold cycles during frame update periods.

FIG. 10 shows another embodiment wherein frame writing may take a variable amount of the frame update period, and the hold cycle periods are adjusted in length in order fill the time between completion of the display write process for one frame and the beginning of the display write process for the subsequent frame. In this embodiment, the time to write a frame of data, e.g. periods 40 and 42, may vary depending on how different a frame of data is from the preceding frame. In FIG. 10, Frame N requires a complete frame write operation, wherein all the rows of the array are strobed. To do this in both polarities requires time periods 40 and 42 as illustrated in FIGS. 8 and 9. For Frame N+1, only some of the rows require updates because in this example, the image data is the same for some of the rows of the array. Rows that are unchanged (e.g. row 1 and row N of FIG. 10) are not strobed. Writing the new data to the array thus requires shorter periods 70 and 72 since only some of the rows need to be strobed. For Frame N+1, the hold cycles 44, 46 are extended to fill the remaining time before writing Frame N+2 is to begin.

In this example, Frame N+2 is unchanged from Frame N+1. No write cycles are then needed, and the update period for Frame N+2 is completely filled with hold cycles 44 and 46. As described above, more than two hold cycles, e.g. four cycles, eight cycles, etc. could be used.

Figure 11:
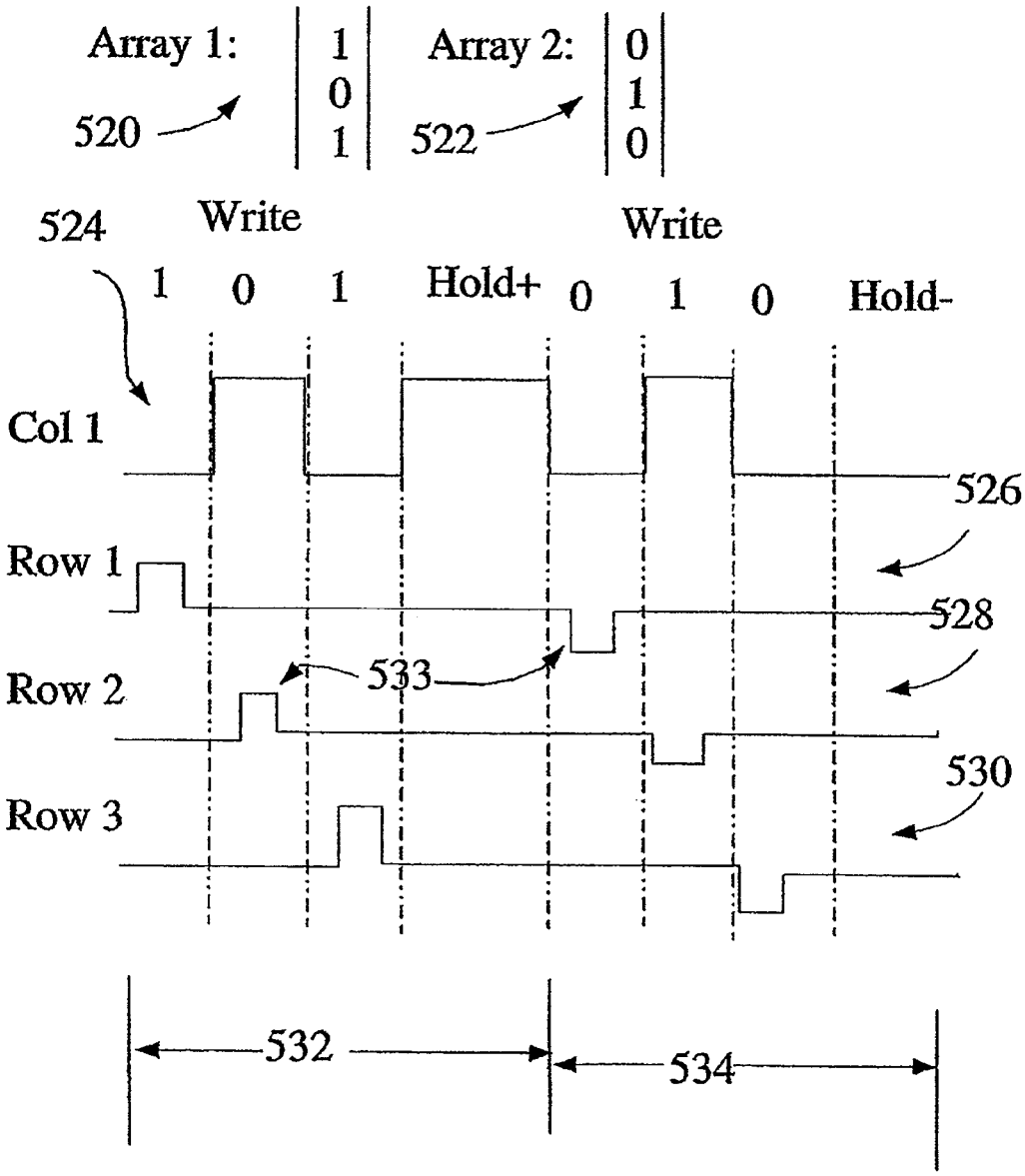
FIG. 11 is a timing diagram illustrating a drive process according to an embodiment.

FIG. 11 is a state diagram illustrating voltage differences with respect to time, for two frames in which a 1×3 array is updated using a preferred driving process. A first array status 520 represents a first frame, and the second array status 522 represents a second frame. A "1" in the array status 520 and the array status 522 illustrate an interferometric modulator in the "OFF," or near, position. The column 1 signal 524 provides the data signal for column 1 of the array 520. If additional columns were present, they could function simultaneously using the same row signals, wherein the pulses act as timing pulses to address the row.

During the first frame update 532, the column signal 524 is logically inverted from the data pattern of column 1 in the first array 520. The row signals 526, 528, and 530 will act as timing signals, wherein a pulse 533 indicates addressing of the row. In the first frame update 532, the row signals 526, 528, and 530 will pulse high. When the column signal 524 is low while a row signal is high, there will be a voltage difference across the electrodes of the particular interferometric modulator at the intersection of the column and row. When the first row signal 526 goes high, the column data signal 524 is low. The deformable layer 34, for example, will collapse if it was not already collapsed due to the differing voltage applied to the deformable layer 34 and the electrode 16, for example. If the cavity was already collapsed, nothing will happen. When the row 2 signal 528 goes high, the column data signal 524 is also high. In this case, the interferometric modulator addressed will be in the near position because the voltage difference between the deformable layer 34 and the electrode 16 will be low. When the third row signal 530 goes high, the column data signal 524 is low. Here, again, the deformable layer 34 at the particular row and column intersection will collapse if it was not already collapsed due to the differing voltage applied to the deformable layer 34 and the electrode 16.

When the row signals are not pulsing, they may be at a bias voltage. The difference between the bias voltage and the column signal is preferably within the hysteresis window, and thus the layers are maintained in their existing state. After the write cycle of the frame update, a hold cycle may occur. During the hold cycle the row signals 526, 528, and 530 will be at the bias voltage, and the column signal 524 is high. However, the column signal 524 could also be at different voltages, but this will not change the state of the interferometric modulators as long as the voltage differences are within the hysteresis window.

In the next frame update 534, the row signals 526, 528, and 530 sequentially go low to serve as timing pulses for addressing the row. The column signal 524 will be as seen in column 1 of the second array. However, the column data signal 524 will not be inverted from the status array 522 when the row signals go low as the timing pulse. When the row signal goes low, that row is addressed by the column signal 524. When the row signal is low and the column signal is low, there will be a very small voltage difference across the electrodes. For example, the column data signal 524 is high when the row voltage 526 is low, there will be a small voltage difference between the deformable layer 34 and the electrode 16. Thus, the deformable layer 34 will no longer be attracted to the electrode 16, and the deformable layer 34 will release, raising the reflective layer 14, for example, from an oxide layer formed on the electrode 16, for example. When the second row signal 528 goes low, the column data signal 524 is high. The deformable layer 34 will collapse if it was not already collapsed due to the differing voltage applied to the deformable layer 34 and the electrode 16. When the third row signal 530 goes low, the column data signal 524 is low. The deformable layer 34 will move away from the oxide layer if it was already collapsed due to the low voltage difference applied to the deformable layer 34 and the electrode 16. When the row signals are at the row bias voltage, the voltage difference is preferably within the hysteresis window and no change in state occurs. After the write cycle of the frame update, a hold cycle may occur. During the hold cycle the row signals 526, 528, and 530 will be at the bias voltage, and the column signal 524 is low. However, the column signal 524 could also be at different voltages, as long as the voltage difference is within the hysteresis window.

As mentioned above, the frame update cycles preferably also include a hold cycle. This will allow for time for new data to be sent to refresh the array. The hold cycle and the write cycles preferably alternate polarities so that a large charge does not build up on the electrodes. The row high voltage is preferably higher than the row bias voltage, which is higher than the row low voltage. In a preferred embodiment, all of these voltages applied on the column signal 524 and the row signals 526, 528, 530 are greater than or equal to a ground voltage. Preferably, the column hold voltages vary less than the column write voltages, so that the difference between the hold voltages and the row bias voltage will stay within the hysteresis window. In an exemplary embodiment, the column high and column low voltages vary by approximately 20 Volts, and the hold voltages vary 10 Volts. However, skilled practitioners will appreciate that the specific voltages used can be varied.

Note that the actuation or release of the upper membrane is not instantaneous. In order for the change in state to occur, the voltage must be outside the hysteresis window for a set length of time. This time period is defined by the following equation:

$$\tau_{Change\ Voltage} > \tau_{iMoD} + \tau_{RC}$$

In other words, in order to change the state of the interferometric modulator, the time at the change voltage, i.e. a voltage either greater than the actuation threshold voltage or less than the release threshold voltage, should be greater than the sum of two time constants. The first time constant is a mechanical constant of the interferometric modulator, which is determined with reference to the thickness of the electrodes, the dielectric material, and the materials of the electrodes. Other factors that are relevant to the mechanical constant include the geometry of the deformable layer 34, the tensile stress of the deformable layer 34 material, and the ease with which air underneath the interferometric modulator reflective layer 14 can be moved out of the cavity. The ease of moving the air is affected by placement of damping holes in the reflective layer 14. The second time constant is the time constant of the resistance and capacitance in the circuit connecting the driving element and the interferometric modulator.

Referring to FIG. 11, when the timing pulse (such as the timing pulse 533) is not present on the row signals 526, 528, 530, a bias voltage may be applied. In order to maintain the setting of the interferometric modulator when the bias voltage is applied on the timing signal, one of two conditions should be met. The first condition is that the absolute value of the voltage difference between the deformable layer 34 and the electrode 16 does not exceed an actuation voltage or fall below a release voltage, for example as illustrated an described in reference to FIG. 3. Thus, the absolute value of the (column minus row) voltage should have a value greater than the release voltage, but less than the actuation voltage, to remain in the hysteresis window. Thus, the column data signal should vary from the row bias voltage by at least the release voltage, but less than the actuation voltage. This may be used when only one polarity is used for the data signal and timing signal. This is preferred when the electronics are not capable of sourcing a large amount of current or the impedance on the lines of the circuit is large.

In addition to the first condition or in the alternative, the second condition should be met to avoid accidental state changes. The second condition is that the RMS voltage across the two electrodes (column minus row) should be greater than the absolute value of the release voltage and less than the absolute value of the actuation voltage. When the voltage hops between the negative hysteresis window and the positive hysteresis window in FIG. 3, the RMS voltage will enable the state to remain constant. RMS voltages vary based upon the transition time. In a preferred embodiment, the voltages on the electrodes switch rapidly, thus maintaining a large RMS voltage. If the voltage switches polarities slowly, the RMS voltage will fall and accidental state changes could occur.

It will be understood by those of skill in the art that numerous and various modifications can be made without departing from the spirit of the present invention. Therefore, it should be clearly understood that the forms of the present invention are illustrative only and are not intended to limit the scope of the present invention.

What is claimed is:

1. An apparatus for displaying images, comprising:

an electromechanical display element comprising at least a portion of an array of electromechanical display elements;

a column driver configured to assert a voltage on one or more columns of the array; and a row driver configured to pulse one or more rows of the array with a voltage, wherein the column driver and row driver are configured to apply a plurality of potential differences across the electromechanical display element during a display write process, the column driver and row driver being configured to write display data to the electromechanical display element with a first potential difference of a first polarity during a first portion of the display write process, re-write the display data to the electromechanical display element with a second potential difference having a polarity opposite the first polarity during a second portion of the display write process, apply a third potential difference having the first polarity to the electromechanical display element during a third portion of the display write process, and apply a fourth potential difference having the opposite polarity to the electromechanical display element during a fourth portion of the display write process, wherein a state of the electromechanical display element does not change during or between the third and fourth portions of the display write process, wherein a transition time between applying the third and fourth potential differences is less than or equal to $\tau_{iMoD}+\tau_{RC}$, wherein $\tau_{iMoD}$ includes a constant of said electromechanical display element determined with reference to physical characteristics of said electromechanical display element, and wherein $\tau_{RC}$ includes a constant related to electrical characteristics of said electromechanical display element.

2. The apparatus of claim 1, wherein the column driver and row driver are configured to write a first frame of display data to the array of electromechanical display elements during the first portion of the display write process, and are configured to re-write the first frame of display data to the array of electromechanical display elements during the second portion of the display write process.

3. The apparatus of claim 2, wherein the column driver and row driver are configured to hold the first frame of display data during the third and fourth portions of the write process following said re-writing.

4. The apparatus of claim 3, wherein said column driver and row driver are configured to write a second frame of display data to the array by writing and re-writing to the electromechanical display elements in the array with opposite polarities and applying potential differences to the electromechanical display elements in the array with opposite polarities, wherein a state of the electromechanical display elements in the array does not change during the applying.

5. The apparatus of claim 1, wherein said first, second, third, and fourth portions of said display write process each comprise approximately one-fourth of a time period defined by the inverse of a rate at which frames of display data are received by a processor in communication with the column driver and row driver.

6. The apparatus of claim 1, wherein said first portion and said second portion together comprise less than ½ of a time period defined by the inverse of a rate at which frames of display data are received by a processor in communication with the column driver and row driver.

7. The apparatus of claim 1, wherein said first portion extends for a first time period and said second portion extends for a second time period, said first and second time periods being determined based at least in part on a polarity dependent dielectric charging rate of the electromechanical display element.

8. The apparatus of claim 1, wherein the apparatus is configured such that one or more of a time for writing using the first potential difference, a time for re-writing using the second potential difference, a time for applying the third potential difference, a time for applying the fourth potential difference, and a time for pulsing the rows is programmable.

9. An apparatus for actuating an electromechanical display element, said electromechanical display element comprising a portion of an array of electromechanical display elements, said apparatus comprising:

means for writing display data to said electromechanical display element with a potential difference of a first polarity during a first portion of a display write process;

means for re-writing said display data to said electromechanical display element with a potential difference having a polarity opposite said first polarity during a second portion of said display write process;

means for applying a first bias potential having said first polarity to said electromechanical display element during a third portion of said display write process; and means for applying a second bias potential having said opposite polarity to said electromechanical display element during a fourth portion of said display write process, wherein a state of said electromechanical display element does not change during or between said third and fourth portions, wherein a transition time between applying the first and second bias potentials is less than or equal to $\tau_{iMoD}+\tau_{RC}$, wherein $\tau_{iMoD}$ includes a constant of said electromechanical display element determined with reference to physical characteristics of said electromechanical display element, and wherein $\tau_{RC}$ includes a constant related to electrical characteristics of said electromechanical display element.

10. The apparatus of claim 9, wherein one or more of the means for writing, means for re-writing, means for applying a first bias potential, and means for applying a second bias potential comprises a column driver circuit configured to assert a voltage on one or more columns of the array of electromechanical display elements.

11. The apparatus of claim 9, wherein one or more of the means for writing, means for re-writing, means for applying a first bias potential, and means for applying a second bias potential comprises a row driver circuit configured to pulse one or more rows of the array of electromechanical display elements with a voltage.

12. A system for writing frames of display data, comprising:

an array of electromechanical display elements; and an array controller comprising a column driver and a row driver, the column driver configured to assert a potential on one or more columns of the array, the row driver configured to pulse one or more rows of the array with a potential, wherein the array controller is configured to write display data to the electromechanical display elements, the writing requiring less than a defined frame update period, and wherein the array controller is further configured to apply a series of bias potentials of alternating polarity to the electromechanical display elements for the remainder of said frame update period, and wherein a state of the electromechanical display elements does not change during the remainder, wherein a transition time between a pair of consecutive bias potentials is less than or equal to $\tau_{iMoD}+\tau_{RC}$ wherein $\tau_{iMoD}$ includes a constant of said electromechanical display elements determined with reference to physical characteristics of said electromechanical display elements, and wherein $\tau_{RC}$ includes a constant related to electrical characteristics of said electromechanical display elements.

13. The system of claim 12, wherein frames of display data are written to the electromechanical display elements at a rate of one frame per defined frame update period.

14. The system of claim 12, wherein said series comprises a bias potential of a first polarity applied during approximately half of the remainder, and a bias potential of a second opposite polarity applied during approximately half of the frame update period.

15. The system of claim 12, wherein the series of bias potentials comprises a polarity balanced sequence of bias voltages applied to substantially all columns of the array, and wherein the remainder is defined by a time remaining between completing a writing of display data for a first frame and beginning a writing of display data for a next subsequent frame.

16. The system of claim 12, wherein said column driver is configured to apply the same voltage to substantially all columns of the array during at least a portion of said frame update period.

17. The system of claim 12, wherein the series of bias potentials comprises approximately equal bias voltages of opposite polarities, and wherein the remainder is defined at least in part by the inverse of a rate at which frames of display data are received by the system.

18. The system of claim 17, wherein the remainder is substantially equal to 1/(2f), wherein f is a defined frequency of frame refresh cycles.

19. The system of claim 17, wherein the remainder varies based at least in part on a number of rows being written with display data that is different from display data written in a previous frame update period.

20. An apparatus for writing frames of display data to an array of electromechanical display elements at a rate of one frame per defined frame update period, said apparatus comprising:

means for writing display data to said electromechanical display elements, wherein said writing takes less than said frame update period; and means for applying a series of bias potentials of alternating polarity to said electromechanical display elements for the remainder of said frame update period, wherein a state of said electromechanical display elements does not change during said remainder, wherein a transition time between a pair of consecutive bias potentials is less than or equal to $\tau_{iMoD}+\tau_{RC}$, wherein $\tau_{iMoD}$ includes a constant of said electromechanical display elements determined with reference to physical characteristics of said electromechanical display elements, and wherein $\tau_{RC}$ includes a constant related to electrical characteristics of said electromechanical display elements.

21. The apparatus of claim 20, wherein at least one of the means for writing and the means for applying comprises an array controller configured to provide signals to the array.

22. A device for driving display elements, comprising:

a display comprising a plurality of pixels; and a display controller configured to periodically release substantially all pixels of said display, the display controller being configured to periodically release each pixel such that there is no perceptible effect on visual appearance of the display to a normal observer, wherein each pixel is released at a rate of less than once per frame.

23. The device of claim 22, wherein any given periodically released pixel is released at a rate slower than once per hour of display use.

24. The device of claim 22, wherein any given periodically released pixel is released at a rate slower than once per 100,000 displayed frames of image data.

* * * * *